US005259362A

United States Patent [19]

Krieger

[11] Patent Number: 5,259,362

[45] Date of Patent: Nov. 9, 1993

[54] SIDEWALL GUIDE FOR COMBUSTION GRATES

[75] Inventor: Friedrich Krieger, Würzburg, Fed. Rep. of Germany

[73] Assignee: Noell K&K Abfalltechnik GmbH, Neuss, Fed. Rep. of Germany

[21] Appl. No.: 896,331

[22] Filed: Jun. 10, 1992

[30] Foreign Application Priority Data

Jun. 10, 1991 [DE] Fed. Rep. of Germany ..... 4119405

[51] Int. Cl.[5] ..... F23H 7/08

[52] U.S. Cl. ..... 126/175; 110/281; 126/152 B; 126/174

[58] Field of Search ..... 126/153, 152 R, 152 B, 126/176 R, 174, 175; 110/281, 282, 283, 284; 198/777, 773, 774

[56] References Cited

U.S. PATENT DOCUMENTS

| | | | |
|---|---|---|---|
| 4,018,168 | 4/1977 | Andreoli et al. | 126/174 X |
| 4,981,090 | 1/1991 | Andersen | 126/152 B X |
| 5,178,128 | 1/1993 | Krieger | 126/175 |

FOREIGN PATENT DOCUMENTS

| | | |
|---|---|---|
| 0165432B1 | 5/1989 | European Pat. Off. . |
| 2652475A1 | 11/1978 | Fed. Rep. of Germany . |
| 3813441A1 | 4/1988 | Fed. Rep. of Germany . |
| 585372 | 2/1977 | Switzerland . |
| 619764 | 10/1980 | Switzerland . |

*Primary Examiner*—Edward G. Favors
*Attorney, Agent, or Firm*—Cohen, Pontani, Lieberman, Pavane

[57] ABSTRACT

A furnace having a thrust grate formed of grate bars which are loosely disposed on alternate movable and stationary grate bar supports, having freedom of movement to tilt in a vertical direction. In a horizontal direction, a grate bar is fixed on each grate bar support, preferably in the middle, and neighboring grate bars are connected to each other, the outermost grate bar on the stationary grate bar support being coupled to a driving element and which, upon thermal expansion, displaces a side shield with respect to the furnace wall.

6 Claims, 3 Drawing Sheets

SIDEWALL GUIDE FOR COMBUSTION GRATES

FIELD OF THE INVENTION

The present invention relates to a thrust grate for incineration furnaces with grate bars arranged on stationary and movable grate bar supports, as well as a lateral guidance and sealing member for a combustion grate.

BACKGROUND OF THE INVENTION

In refuse incineration plants, various combustion grates are used. In larger plants, clamped or compressed grates are frequently used.

In the case of non-clamped or non-compressed grates, grate bars which have expansion play on their sides are customarily used, as known from Federal Republic of Germany Patent Document DE A1-26 52 475. This expansion play is generally distributed non-uniformly over the entire width of the grate. On the sides facing the furnace walls, there is generally a further air gap provided to allow expansion play. In the case of these known grates, the air gaps lead to an uncontrolled admission of air from the bottom or undergrate air region to the material being incinerated.

In addition to the problem of uncontrolled admission of combustion air or uncontrollable pressure of the furnace atmosphere, dropping of the material being incinerated through the slots is frequently observed, leading to a corresponding deposit of ash below the grate and the subjecting of the structural parts located below the grate to unintended elevated temperatures.

One particular problem is caused by the deposits of nonferrous metals which melt at a lower temperature and flow through such slots between and alongside the grate bars or, for instance, steel scrap which becomes jammed between the grate bars and thus restricts the mobility of the bars.

Therefore, grate bars which have been milled flat on the side and lie alongside of each other are known, which are connected by individual attachment devices, such as screws, in order to form a slot-free combustion grate surface, as shown in Federal Republic of Germany Patent Document DE A1-38 13 441.

Reciprocating grates for refuse incineration furnaces having, transverse to the grate, rows of grate bars which are movable in the direction of advance of the grate, are also known from Swiss Patent Document CH 585 372. The grate bars are clamped resiliently together without any gap, according to this method. This furnace has a shield which limits the grate on the side and which is also pressed by screw springs against the grate bars.

It is also known to use a system in which shields press the grate bars together by means of a clamping device which rests against the furnace wall. The clamping device is formed in this case of a plurality of hinges with telescopic guides under spring action which lie between them, the hinges being fastened to the shield and to the furnace wall. This system is very expensive to construct due to its large number of component parts.

Swiss Patent Document CH 619 764 discloses spring-loaded spreading elements between and alongside of the grate bars, the elements connecting all the grate bars and the side shields together being under the influence of spring forces. One problem in this connection consists of the cup springs, which must apply constant, uniform spring forces over a large temperature range and over a pressure range which varies due to thermal expansion of the grate bars and of the tie rod. These conditions are not assured in actual practice. The springs or movable rod parts are subjected to the high temperatures of the furnace and the residues of combustion material which are necessarily produced, thereby making it difficult to satisfy the necessary conditions.

European Patent Document EP B1 0 165 432 discloses a thrust grate in which the grate bars, which are arranged in the manner of roof tiles, have air inlet slots on their front surface for undergrate air, and in which the side shields are connected together by a tie rod. Cup springs are arranged between the grate bars for equalization of expansion. Profiled sealing sections arranged on the furnace wall have a well-defined play with respect to the side shields so that thermal expansion of the stationary grate bar supports is possible. EP B1 0 165 432 does not disclose how the movable rows of grate bars are constructure in this system nor how they cooperate with the side shields. The problem of the uncontrolled admission of undergrate air is, however, eliminated only in the case of relatively new furnaces. As soon as the surfaces of the grate bars have become worn due to the action of temperature and abrasion, they no longer lie against each other. The tie rod prevents the lowering of the row of grate bars onto the grate bars of the preceding row and gaps are thus produced between the upper and lower surfaces of the grate bars. Furthermore, in the event of repair, it is not possible to replace individual grate bars or to remove the approximately yard-long tie rod easily.

OBJECTS AND SUMMARY OF THE INVENTION

It is therefore an object of the present invention to clamp the grate bars of the stationary and movable rows of grate bars together in as simple a manner as possible, without any substantial air gaps being present between the individual grate bars and towards the furnace wall.

The present invention seeks to solve this problem by providing an incineration furnace having grate bars loosely lying on alternately stationary and movable grate bar supports, which bars form a thrust grate, in which at least one grate bar on each grate bar support has a horizontally acting fixed point and the adjacent grate bars are in each case connected to each other, and which has, at least on one side of a combustion space, a closure member which includes a sealing rail and a side shield loosely mounted on the statinary grate bar supports, said side shield element along the outer grate bars. According to a further advantageous embodiment, the fixed point lies approximately in the center of the grate bar support. Further, it is also advantageous for the side shield to include a sleeve which loosely surrounds the grate bar support and, firmly connected to the sleeve, a support wall, a cover ledge and a wear plate, the sleeve surrounding the driving element with play in a form-locked manner, i.e. having a mechanical interference type fit.

The various embodiments described above may also include a slot between the sealing rail and the side shield which is closed or sealed by a slot ledge which lies loosely on the side shield.

According to the present invention, the problems of uncontrolled admission of air through the grate surface or through the side-wall seals in such furnaces having grate bars which lie loosely on alternately fixed and movable grate bar supports, and form a closed thrust-grate surface are avoided or alleviated by providing a fixed bearing for each grate bar support, the adjacent grate bars being connected to each other, and providing a furnace closure on at least on one side of the thrust grate, formed by a sealing rail on the furnace wall and side shield which is loosely mounted on the stationary grate bar support, which is displaceable by driving elements connected to the outer grate bars.

The side shield itself consists of a sleeve which loosely surrounds the grate bar support and of a supporting wall which is bolted or welded to the sleeve, which in turn is connected to a cover ledge, the surface of which is parallel to parts of the sealing rail and to parts of a wear plate. The sleeve and its components part surround the driving element in form-locked manner with play. The outer grate bars on the furnace walls are of variable width and, when cold, conform, with a certain degree of play, to the wear plates.

According to the present invention, by the coupling of each of the grate bars by, for instance, lateral bolting thereof with the adjacent grate bars, a tight grate surface is obtained without stresses being produced in the thrust grate due, for instance, to a tie rod which holds all of the grate bars together jointly, as known in the prior art.

The grate bars are coupled in a row and lie, in accordance with the present invention, loosely on the grate bar supports, held in form-locked manner, e.g. with a mechanical interference fit, in the direction of advancement. Accordingly, the grate bars may carry out a slight vertical tilting movement around their point of support and therefore always lie on or against the grate bars arranged adjacent to and in front of them, regardless of thermal expansion, wear, etc. Surface wear of the grate bars is thereby compensated for and the undesired formation of a gap with consequent uncontrolled feed of undergrate air through the rows of grate bars being avoided.

Typically, grate bars do not become worn uniformly over their entire surface but rather form linear depressions along the row of grate bars. In this way, the primarily linear advance of the movable grate bar supports is converted with increasing duration of the operation into an increasingly sinusoidal movement of the heads of the grate bars. This course of movement of the grate bars is made possible only by the tilting of the grate bars on the grate bar support. This type of attachment of the grate bars permits easy replacement of individual grate bars when the furnace is not in operation.

The outer grate bars are so dimensioned that the remaining gaps between wear plate and outermost grate bar are closed after all of the grate bars are resting on a grate bar support. This tends to compensate for manufacturing tolerances of the grate bars.

Different temperatures can prevail in the longitudinal direction of the furnace, so that the calculatable expansion of the grate bars must be adapted to these various temperature conditions. By selection of the position of the fixed point of attachment, the expansion of the bars towards the left or right furnace wall from that point can then be determined. If the fixed point is arranged at one end of a grate bar support, a displaceable side shield can be dispensed with on that side of the furnace. However, it is preferred in very wide furnaces that the fixed point not be at the end, but rather approximately in the center, and that a displaceable side shield be provided at both ends, because there is no assurance in such case that the rows of grate bars will not sink completely onto the preceding rows of grate bars after wearing.

A driving element shaped to have a circular segment is bolted to the outer grate bars, on a side facing towards the furnace wall. The driving element engages into a gap in the side shield so that, upon expansion of the grate bars, this side shield, which is mounted with play on the grate bar support, can shift. The shape of the driving element also assures displacement of the side shield resulting from a tilting movement of the grate bars.

The side shields, which are arranged one behind the other, rest in each case only on the stationary grate bar supports. The movable grate bar supports of the thrust grate, which are arranged between the stationary grate bar supports and therefore the side shields, do not have such a driving element since they carry out their reciprocating motion between the side shields.

The side shields are provided with wear plates, towards the furnace side, which may consist, for instance, of cast plates. Due to thermal expansion and contact with the material being incinerated on the thrust grate, as well as sliding contact with the outermost grate bars on the movable grate bar rows, these wear plates must be replaced from time to time. As already mentioned, the wear plates extend only from one stationary grate bar support to the next and have little play in a direction towards the adjacent wear plates. The typical length of the wear plates is, for instance, 600 mm; they can therefore be easily replaced in view of their arrangement and size.

For the lateral sealing of the combustion space on the furnace wall, a slot ledge can be provided which is held in form-locked manner, i.e. by a mechanical interference fit, by the sealing rail in a lateral direction, and which rests loosely on the surface of the cover ledge of the side shield. In this way, it can be assured that the side shield can move as a result of thermal expansion and, nevertheless, maintain an air-tight condition.

BRIEF DESCRIPTION OF THE DRAWINGS

The preferred embodiments are shown by way of example in the accompanying drawings in which.

DETAILED DESCRIPTION OF THE PREFERRED EMBODIMENTS

Figure 1:
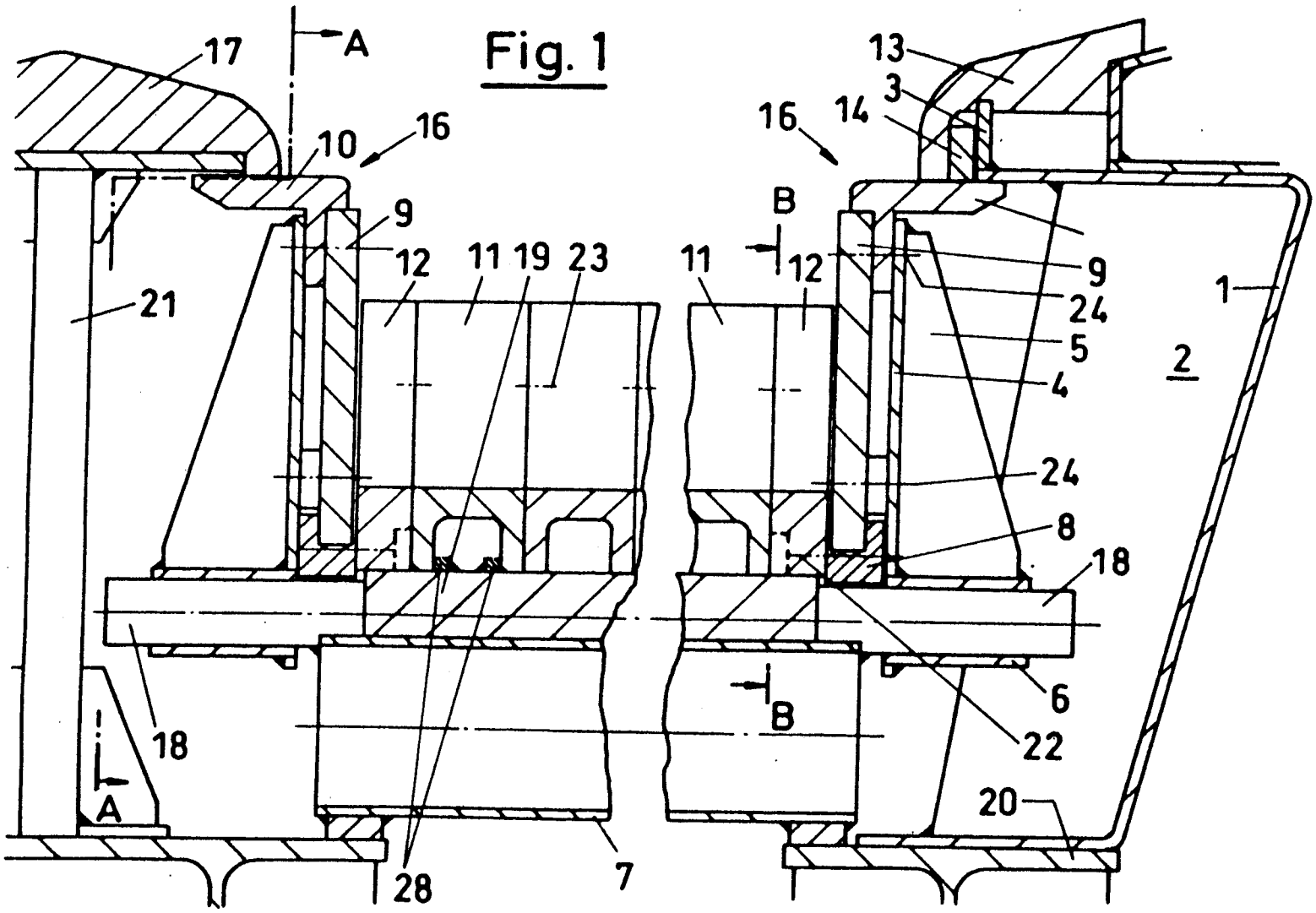
FIG. 1 is a section taken transversely through a furnace in accordance with the present invention.
Figure 2:
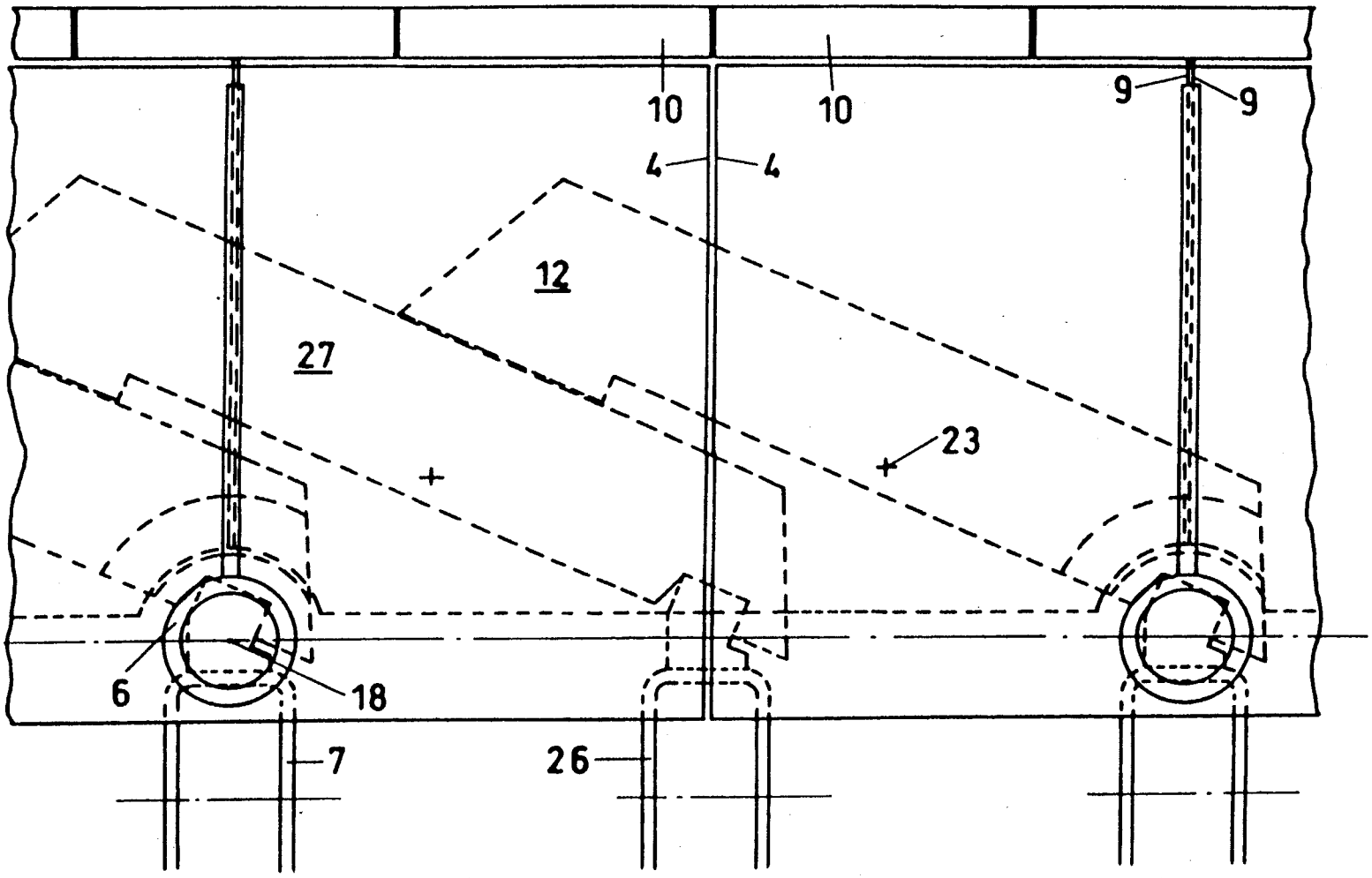
FIG. 2 is a side view of a side shield along the section line A—A of FIG. 1.
Figure 3:
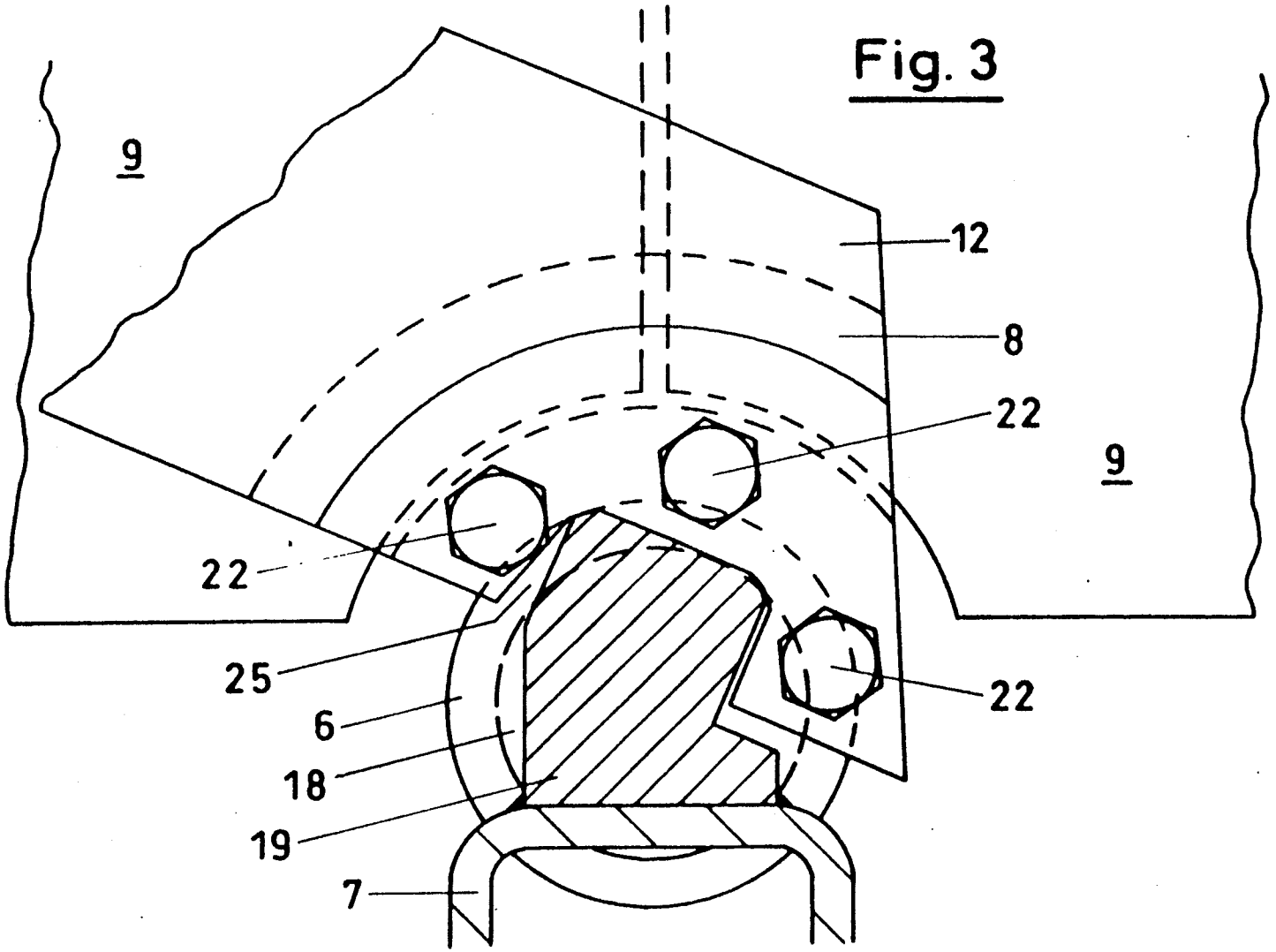
FIG. 3 is a side view of a driving element along the section line B—B of FIG. 1.

The combustion space 15, i.e. the fire space above the grate bars, of a refuse incineration furnace, is screened off or divided from the space outside by a furnace wall 2 consisting of a steel plate 1. A two-path thrust grate has a surface formed by the grate bars 11, 12 on the stationary grate bar supports 7 and grate bars 27 on the movable grate bar supports 26, as shown in FIG. 2. The two-path thrust gate lies on a substructure consisting of I-beams 20 and stationary grate bar supports 7, as well as the movable grate bar supports 26, not shown in FIG. 1. The right path of the two-path thrust grate shown in FIG. 1 is limited on one side by the furnace wall 2 and on the other side by the middle support 21. A support ledge 19 is firmly welded to the fixed grate bar supports 7. The support ledge 19 terminates at both ends in a cylindrical pin 18. The grate bars 11 and 12, which are connected to each other by bolts 23, as shown schematically in FIGS. 1 and 2, rest on the support ledge 19. A sleeve 16 is welded to a support wall 4, which has an outwardly extending rib 5. The sleeve 16 rests with play on the pins 18. This support wall 4 serves as a support for a cover ledge 10 and as an abutment for the wear plate 9, which is formed of cast iron, both of which are connected by bolts 24, shown schematically in FIG. 1, to the support wall. The complete side shield 16 is formed of the support wall 4, the wear plate 9 and the cover ledge 10, and is bolted together by the bolts 24. The complete side shield 16 is connected in form-locked manner, i.e. by a mechanical interference fit, to the grate bars 11, 12 by the segment-shaped driving elements 8, as shown in FIG. 3, which are held by bolts 22 onto the grate bar 12.

The steel plate structure 1 of the furnace wall 2 is welded to a mount 3 which serves as support for the sealing rail 13. The gap between the sealing rail 13 and the cover ledge 10 is closed by a slot ledge 14, which is arranged loosely in a recess between the sealing rail 13 and the mount 3. Upon lateral expansion of the grate bars 11, 12, a displacement of the side shield 16 necessarily results, relative to the slot ledge 14 and the sealing rail 13 in the furnace wall 2. A grate bar 11 is fixed in the center of the grate bar support 7 in a horizontal direction by two stops 28.

The sealing rail 17 is arranged on the central support 21 towards the center of the furnace. Here, also, the thrust grate is limited laterally by a side shield 16 which is identically formed in a manner corresponding to the side shield arranged on the right side of the furnace. Alternatively, the side shield 16 may be formed without a slot ledge present between the sealing rail 17 and the cover ledge 10.

FIG. 2 shows that the wear plates 9 in each case rest on the stationary grate bar supports 7 and are limited lengthwise to the distance between the fixed grate bar supports 7. The movable grate bar support 26 lying in between, together with the grate bar 27, terminates in front of the wear plates 9. The support wall 4 is twice as long as one of the wear plates 9; the support walls 4 have their joints arranged between the stationary grate bar supports 7.

FIG. 3 shows the attachment of the driving elements 8 by the bolts 22 to the grate bar 12. This grate bar 12 and all of the other grate bars have a conically opening recess 25, which is larger than necessary for a form-lock fit with the support ledge 19, and are therefore seated loosely on the support ledge 19 of the fixed grate bar support 7. Therefore, the grate bar 12 can tilt in a forward direction. The grate bar has a length of about 500 mm, a thickness of about 120 mm, and is installed at an angle of about 24°. Under such conditions, wear of the surface of the grate bar, constituting a partial decrease in the thickness dimension, of about 20 mm is allowed for during the course of one furnace operation session. A decrease in thickness of about 20 mm results a change in a tilting angle of the grate bar by up to about 6°.

It should be understood that the preferred embodiments and examples described are for illustrative purposes only and are not to be construed as limiting the scope of the present invention which is properly delineated only in the appended claims.

What is claimed is:

1. A furnace including a wall bounding a combustion space, comprising:

a thrust grate comprising rows of adjacently disposed stationary and displaceable grate bars alternately arranged beneath the combustion space, each row of stationary and each row of displaceable grate bars comprising a plurality of inner grate bars (11, 27) bounded by an outer grate bar (12);

a plurality of alternately arranged stationary and displaceable grate bar supports (7, 26) for loosely supporting said respective stationary and displaceable rows of grate bars, adjacent grate bars being connected to each other and at least one of said grate bars of each row of grate bars being fixedly supported at a fixation point (28) on said grate bar support against horizontal movement;

at least one closure member between the wall and the combustion space comprising a sealing rail (13) and a side shield (16) loosely engaging said stationary grate bar supports (7); and a driving element (8) for displacing said side shield along said outer grate bars (12).

2. The furnace according to claim 1, wherein said fixation point (28) is disposed approximately in the center of said grate bar supports (7, 26).

3. The furnace according to claim 1, wherein said side shield (16) comprises a sleeve (6) loosely surrounding said displaceable grate bar support (7); a support wall (4) mounted on said sleeve; a wear plate (9) linked to said driving element (8) by a mechanical interference fit with play; and a cover ledge (10) disposed above said support wall and said wear plate and being connected to said sleeve (6).

4. The furnace according to claim 1, having a slot between said sealing rail (13) and said side shield (16) and further comprising a slot ledge (14) on said side shield for closing the slot between said sealing rail (13) and said side shield (16).

5. The furnace according to claim 2, having a slot between said sealing rail (13) and said side shield (16) and further comprising a slot ledge (14) on said side shield for closing the slot between said sealing rail (13) and said side shield (16).

6. The furnace according to claim 3, having a slot between said sealing rail (13) and said side shield (16) and further comprising a slot ledge (14) on said side shield for closing the slot between said sealing rail (13) and said side shield (16).

* * * * *